US009289641B2

(12) United States Patent
Richardson et al.

(10) Patent No.: US 9,289,641 B2
(45) Date of Patent: Mar. 22, 2016

(54) ANTIGRAVITY WHOLE BODY EXERCISE GARMENTS

(75) Inventors: David Alexander Richardson, Auchenflower (AU); Carolyn Anne Richardson, Warana (AU)

(73) Assignee: GRAVITY FITNESS AUSTRALIA PTY LTD, Brisbane, Queensland (AU)

( * ) Notice: Subject to any disclaimer, the term of this patent is extended or adjusted under 35 U.S.C. 154(b) by 160 days.

(21) Appl. No.: 13/813,513

(22) PCT Filed: Aug. 4, 2011

(86) PCT No.: PCT/AU2011/000993

§ 371 (c)(1),
(2), (4) Date: Jan. 31, 2013

(87) PCT Pub. No.: WO2012/016292

PCT Pub. Date: Feb. 9, 2012

(65) Prior Publication Data

US 2013/0130874 A1 May 23, 2013

(30) Foreign Application Priority Data

Aug. 4, 2010 (AU) ..... 2010903481
Mar. 21, 2011 (AU) ..... 2011901023

(51) Int. Cl.
*A63B 21/00* (2006.01)
*A63B 21/02* (2006.01)
(Continued)

(52) U.S. Cl.
CPC ..... *A63B 21/02* (2013.01); *A63B 21/0555* (2013.01); *A63B 21/4003* (2015.10); *A63B 21/4007* (2015.10); *A63B 21/4009* (2015.10); *A63B 23/035* (2013.01);
(Continued)

(58) Field of Classification Search
USPC ..... 482/57, 121–129; 2/456
See application file for complete search history.

(56) References Cited

U.S. PATENT DOCUMENTS 1,618,273 A 2/1927 Davidson
4,698,847 A * 10/1987 Yoshihara ..... 2/69
(Continued)

FOREIGN PATENT DOCUMENTS

CN 2415624 Y 1/2001
DE 4430042 A1 3/1995
(Continued)

OTHER PUBLICATIONS

International Search Report for PCT/AU2011/000993, mailed Oct. 19, 2011; ISA/AU.
(Continued)

*Primary Examiner* — Stephen Crow

(57) ABSTRACT

The invention provides an antigravity muscle exerciser comprising a garment which when worn by a user is close-fitting and covers at least the torso of said user. The garment comprises separate top and bottom portions or is a one-piece article, and has incorporated therein first portions of flexible material on each side of the torso which extend from the pelvis to beyond a respective shoulder where the portions are contiguous with a second portion of flexible material which extends across the top of the head of the user in a coronal plane. The portions of flexible material in combination have a length and elasticity which creates axial compression between the top of the head and the pelvis. The invention also provides a method of utilizing the garment exercising deep posture and anti-gravity muscles.

11 Claims, 6 Drawing Sheets

(51) Int. Cl.

| | |
|---|---|
| ***A63B 21/055*** | (2006.01) |
| ***A63B 23/035*** | (2006.01) |
| ***A63B 23/04*** | (2006.01) |
| *A41D 13/00* | (2006.01) |

(52) U.S. Cl.
CPC ..... *A63B 23/0405* (2013.01); *A41D 13/0015* (2013.01); *A63B 21/4025* (2015.10)

(56) References Cited

U.S. PATENT DOCUMENTS

| | | | | |
|---|---|---|---|---|
| 5,109,546 | A * | 5/1992 | Dicker | 2/70 |
| 5,201,074 | A * | 4/1993 | Dicker | 2/70 |
| 5,282,277 | A * | 2/1994 | Onozawa | 2/69 |
| 5,336,139 | A | 8/1994 | Miller | |
| 5,367,708 | A * | 11/1994 | Fujimoto | 2/22 |
| 5,372,565 | A | 12/1994 | Burdenko | |
| 5,737,773 | A * | 4/1998 | Dicker et al. | 2/69 |
| 5,819,322 | A * | 10/1998 | Dicker et al. | 2/456 |
| 5,978,966 | A * | 11/1999 | Dicker et al. | 2/69 |
| 6,047,406 | A | 4/2000 | Dicker et al. | |
| 6,446,264 | B2 * | 9/2002 | Fairhurst et al. | 2/69 |
| 6,684,410 | B2 * | 2/2004 | Robinett et al. | 2/228 |
| 7,374,523 | B2 * | 5/2008 | Weir et al. | 482/148 |
| 7,516,498 | B2 * | 4/2009 | Torry | 2/69 |
| 7,636,950 | B2 * | 12/2009 | Melhart et al. | 2/69 |
| 7,861,319 | B2 * | 1/2011 | Torry | 2/69 |
| 7,945,970 | B2 * | 5/2011 | Belluye et al. | 2/69 |
| 8,312,566 | B2 * | 11/2012 | Weir et al. | 2/69 |
| 8,356,363 | B2 * | 1/2013 | Caillibotte et al. | 2/69 |
| 8,375,468 | B2 * | 2/2013 | Okamoto et al. | 2/69 |
| 8,533,864 | B1 * | 9/2013 | Kostrzewski | 2/69 |
| 2003/0092545 | A1 | 5/2003 | Koscielny et al. | |
| 2007/0135279 | A1 | 6/2007 | Purdy et al. | |
| 2008/0287840 | A1 | 11/2008 | Koscielny et al. | |

FOREIGN PATENT DOCUMENTS

| | | | |
|---|---|---|---|
| GB | 2 461 072 | A | 12/2009 |
| WO | WO-2010079244 | A1 | 7/2010 |

OTHER PUBLICATIONS

Chinese State Intellectual Property Office Search Report for Chinese Application 2011800467812 with English translation mailed Jun. 9, 2015.

European Search Report and Written Opinion for PCT/AU2011/000993 mailed Jul. 6, 2015.

* cited by examiner

ANTIGRAVITY WHOLE BODY EXERCISE GARMENTS

CROSS-REFERENCE TO RELATED APPLICATIONS

This application is a 371 U.S. National Stage of International Application No. PCT/AU2011/000993, filed on Aug. 4, 2011, which claims priority to Australian Patent Application No. 2010903481 filed on Aug. 4, 2010 and Australian Patent Application No. 2011901023, filed on Mar. 21, 2011, the contents of which applications are hereby incorporated by reference in their entirety as if fully set forth herein.

TECHNICAL FIELD

The invention described herein relates generally to exercising the antigravity muscle system. In particular, the invention is directed to exercise garments including suits for use in activating deep posture and anti-gravity extensor muscles in the body, although the scope of the invention is not necessarily limited thereto.

BACKGROUND ART

There are many 'compression' or 'exercise' suits which have been designed to improve sport and athletic performance. They have been specifically designed to have the right compression on the surface of the body to affect circulation and so improve oxygen consumption, delay muscle soreness, and increase power output of the muscles.

The known suits do not incorporate, and are not used for, another type of compression being a compressive force along the longitudinal axis of the trunk and/or limbs which we refer to herein as 'axial compression'. Exercise to counteract axial compression helps develop axial joint stability of the trunk and limbs. Increased axial joint stability leads to improved activation of the core muscles, increased proprioception, improved performance, and helps with the prevention of injuries. It also helps strengthen the bones.

Gravity causes an axial compressive force on the body in a vertical direction. This compressive force compresses our joints, especially the spinal intervertebral discs. Joint compression as a result of gravity occurs during 'body weight' or weight-bearing activities of the trunk, lower limb and upper limb. The most obvious examples of weight-bearing activities that cause axial joint compression are in upright standing and walking where the spinal joints are compressed, holding body weight in upright 'squatting' activities where the lower limb joints are compressed, and holding body weight off the ground with the upper limbs where the joints of the upper limb are compressed.

In 'closed chain' exercises, body weight is moved while the feet or hands are fixed. This type of exercise is the opposite to 'open chain' exercise where the limbs are moving freely on the trunk: for example, kicking or throwing a ball, swinging a club or racquet. If the axial compression of the weight-bearing joints is not counteracted by the bodies antigravity muscle system, this compression will gradually cause injury and pain.

However, as gravity or 'G' is compressing the weight-bearing joints (see FIG. 1A), it provides sensory information about gravity to the joints. The antigravity muscles or 'AG' respond to the feel of increased compression and work in an opposite direction to gravity in a way which 'decompresses' and 'stabilises' the joints of the body to keep them healthy (see FIG. 1B). This also results in an increase in bone density.

Antigravity muscle forces work through three antigravity kinetic chains to lift the body weight against gravity. These antigravity kinetic chains also provide a 'shock absorption' role. The three chains are: the spinal antigravity kinetic chain; the lower limb antigravity kinetic chain; and, the upper limb antigravity kinetic chain. These three kinetic chains are linked through the core muscles in the centre of the body (as described in FIG. 1A and FIG. 1B). In this way, the antigravity muscles of the whole body can be coordinated to resist the compressive force of gravity. The antigravity kinetic chains are described in greater detail in *Beyond the Core to Whole Body* (C. Richardson, ed., Northwater Publishing, Brisbane, Qld, 2009), the entire content of which is incorporated herein by cross-reference.

It would be desirable to have a garment or exercise suit that in use creates axial compression in each of the three kinetic chains at the same time to allow the three antigravity kinetic chains to work together. The wearer of such an exercise suit could therefore exercise his or her anti-gravity muscles of the whole body at the same time as conducting normal exercise or sporting routines, during daily activities or when sitting or lying for prolonged periods. It would also be beneficial for people working in a microgravity environment to maintain a force on the body similar to the normal force of gravity and therefore prevent the deterioration of the antigravity muscles.

Where exercises or activities are performed where the upper and lower limbs take part in closed chain exercises, it may not be necessary for the exercise suit to provide additional axial compression for the upper and/or lower limb antigravity kinetic chains. Therefore, in such a case, the exercise suit would only need to be configured so that the spinal antigravity kinetic chain would have to be activated. Depending on the particular sport or activity involved, the garment or exercise suit for the spinal antigravity kinetic chain could incorporate axial compression for any or both of the upper and lower antigravity kinetic chains.

Despite a need for a garment or exercise suit that can be used to create axial compression in any or all of the three antigravity kinetic chains, such garments or suits have not been provided. The object of this invention is to meet that need.

DESCRIPTION OF THE INVENTION

The inventors have found that resistance bands or other elastic material can be used to 'simulate' the compressive effect of gravity along the longitudinal axis of the trunk, lower and upper limbs as occurs in weight-bearing exercise. In this way, the AG muscles can activate automatically in response to the feel of axial compression produced by the elastic material to give an isometric (static) exercise response. The AG muscles can alternatively be intentionally exercised using isotonic (movement) exercise by:

extending the crown of the head upwards;

extending the upper limbs; and extending the lower limbs;

to further increase the activity levels of the antigravity extensor muscles.

The spinal antigravity kinetic chain is the most vulnerable to antigravity muscle weakness and therefore the most important to facilitate the activation of the antigravity muscles in the body via axial compression.

The inventors have further found that an exercise band or other elastic material passing over the crown of the head can be used to provide axial compression of the whole spine and hence facilitate the antigravity muscles to relieve compressive forces and stabilise the joints of the spine (axial stability).

The spinal antigravity kinetic chain is also facilitated by the natural 'stretch tall' postural cue.

The pelvic girdle (part of the lower limb antigravity kinetic chain) and the shoulder girdle (part of the upper limb antigravity kinetic chain) both form an essential part of the spinal antigravity kinetic chain. It has been further found that for optimal axial compression, sensory effects and antigravity muscle activity, it is best to work all three antigravity kinetic chains together (i.e., whole body 'weight-bearing' exercise).

In a first embodiment, the invention provides an antigravity muscle exerciser comprising a garment fabricated from material which when worn by a user is close-fitting and covers at least the torso of said user, wherein the garment comprises separate top and bottom portions or is a one-piece article, and wherein the garment has incorporated therein:

first portions of flexible material on each side of the torso which extend from the pelvis to beyond a respective shoulder where the portions are contiguous with a second portion of flexible material which extends across the top of the head of the user in a coronal plane, wherein said first portions of flexible material in combination with the second portion of flexible material have a length and elasticity which creates axial compression between the top of the head and the pelvis.

In a second embodiment, the invention provides a method of exercising deep posture and antigravity muscles, the method comprising the steps of:

(a) fitting the garment of the first embodiment;

(b) standing tall and extending the crown of the head to create an upward force away from the pelvis, wherein said extending is to increase axial compression;

(c) reducing the upward force created by the crown of the head against the elasticity of the flexible material of the garment, wherein said reducing is to decrease axial compression;

(d) repeating steps (b) and (c) as required until said deep posture and antigravity muscles are sufficiently exercised; and (e) optionally removing the portion of flexible material across the crown of the head and continuing the repetition of steps (b) and (c).

The terms 'user' and 'wearer' will be used interchangeably throughout this specification.

With reference to the first embodiment of the invention as defined above, the garment in its simplest form is sleeveless but can have legs that extend to just above the knees of the wearer. The garment can also include short sleeves. In this form, the garment is in essence what is typically referred to as a 'spring suit'.

Regarding the portions of flexible material, parts of the first and/or second portions must be elastic or otherwise comprise of material that can stretch and return essentially to its original length (herein referred to as being 'elastic' material). However, the first and second portions in combination can be elastic essentially throughout its length.

The portions of flexible material that extend from the pelvis are advantageously anchored in the pelvic area by what are in effect loops which are worn around the legs of a user in the region of the upper thigh. These looped members are typically strips of material incorporated into, or attached to, the fabric comprising the garment. The looped members can furthermore be contiguous with the first portions of the flexible material. The looped members are advantageously present in combination with a further member that extends across the back of a wearer in the lower lumbar region. The further member can extend around the body of the wearer to in essence form a belt.

For comfort and the better application of compressive force, the portion of flexible material at the crown of the head can comprise branched portions that at their mid-points are separated from 5 to 10 cm. The portion of flexible material, in either the branched or unbranched form, can be incorporated into a hood that is a part of the garment.

In a form of the garment according to the first embodiment, the second portion of flexible material that crosses the head of a wearer can de detachable from the rest of the garment. That is, the second portion can have means that allows it to be detached from the first portions of flexible material at the shoulders of the wearer.

The portions of flexible material of the garment can be any suitable material and can be incorporated into the fabric making up the garment. The incorporation can be by any suitable method including sewing, riveting or bonding. The sections of the flexible material can be contained within a sleeve attached to the fabric of the garment.

The portions of flexible material can alternatively be incorporated into the fabric of the garment. When incorporated into the fabric of the garment, any elastic section of a portion of material can comprise a strip of two-way stretch fabric. In this context, by 'two-way' it is meant that the fabric can predominantly stretch in only one direction. This is in contradistinction to a four-way stretch fabric which can stretch both lengthwise and crosswise. The entire part of the garment covering the torso can be comprised of two-way stretch material.

A garment according to the first embodiment can include means for adjusting the axial compression of the spine by the portions of flexible material. This is most conveniently achieved by including an adaptation in the pelvic area of the garment which allows the portions of the flexible material along the torso and over the head to be in essence shortened or lengthened. This will be explained in greater detail below.

The garment according to the first embodiment of the invention can have full length sleeves and/or legs and hence comprise a whole body suit. The fabric making up the sleeves and/or legs can be the same elastic or flexible material of the garment per se. However, so that axial compression results from extension of the upper limbs, the fabric of the sleeves of the suit extends to at least the heel of each hand. Similarly, so that axial compression results through extension of the lower limbs, the fabric of the legs of the suit extends to at least the heel of each foot.

The sleeves/and or legs of a suit can comprise additional material in the fabric making up the sleeves or legs to increase the longitudinal elasticity between the proximal and distal ends of a limb when the suit is being worn. The additional material can comprise bands of elastic material that are attached to a sleeve anteriorly anywhere between the medial and lateral sides of a upper limb, or attached to a leg posteriorly anywhere between the medial and lateral sides of a lower limb. The additional material can also comprise a continuous band of elastic material that winds around a limb when the suit is being worn.

The additional material in the sleeves and/or legs of a suit advantageously comprises a two-way stretch fabric of the desired elasticity which is incorporated into the material making up the sleeves and/or legs of the suit per se. As such, the additional material extending between the ankle and upper thigh can comprise a panel of two-way stretch fabric which covers all of the back of the leg and can even extend around to the front of the leg. The additional material in sleeves can comprise a two-way stretch fabric. The two-way stretch fabric can, in some embodiments, comprise the entire sleeve of the suit. The flexible material in the torso section of a suit can similarly comprise panels, or a panel, of two-way stretch fabric.

Suits comprising panels of two-way stretch fabric can have panels of different elasticity. That is, the elasticity of a panel in a leg of the suit can be different to a panel in the torso. This can be achieved by using fabrics of different elasticities or by having layers of panels in a particular part of the suit.

In one form of the suit, a hood is included. In yet another form of the suit according to the invention, the suit includes means for attaching additional elastic members to the outside of the suit (to increase the resistance or effect of the axial compression) along the posterior aspect of each lower limb (in the form of the suit that includes full-length legs)., or along the anterior aspect of each upper limb (in the form of the suit that includes full-length sleeves). These forms of the suit will be explained in greater detail below.

The elasticity of flexible material is determined by the intended use of the garment. The physical condition of the user is also taken into account. The elasticity is typically within the range of 5 to 25% of the maximum voluntary extension force regarding the particular antigravity kinetic chain but should not exceed 30% of that force.

With regard to the second embodiment method described above, the portion of flexible material across the head or hood can be removed from the head of the user (removing or significantly reducing the axial compression applied to the spinal antigravity kinetic chain) after the deep posture and antigravity muscles have fatigued or the user no longer requires this axial compression to be applied. This allows the user to comfortably continue wearing the garments or suits without having to completely remove any of the foregoing items. Similarly, the portion of material across the heel of the hand and/or the heel of the foot can be removed to achieve the same purpose in relation to the upper and/or lower limbs.

When a suit including sleeves is used in the method of the invention, the upper limbs can be extended away from the torso to increase axial compression. Similarly, when a suit includes legs, the lower limbs can be extended away from the torso to again increase axial compression. In such usage, step (c) of the method includes relaxation of the upper and/or lower limbs to decrease axial compression.

Garments as described above are advantageously used in conjunction with the article described in the international application entitled 'Posture Indicator' (International Publication Number WO 2007/134380), the entire content of which is incorporated herein by cross-reference.

In order that the invention may be more readily understood and put into practice, one or more preferred embodiments thereof will now be described, by way of example only, with reference to the accompanying drawings.

BEST MODE AND OTHER MODES FOR CARRYING OUT THE INVENTION

Providing Axial Compression of the Spine

Figure 1A:
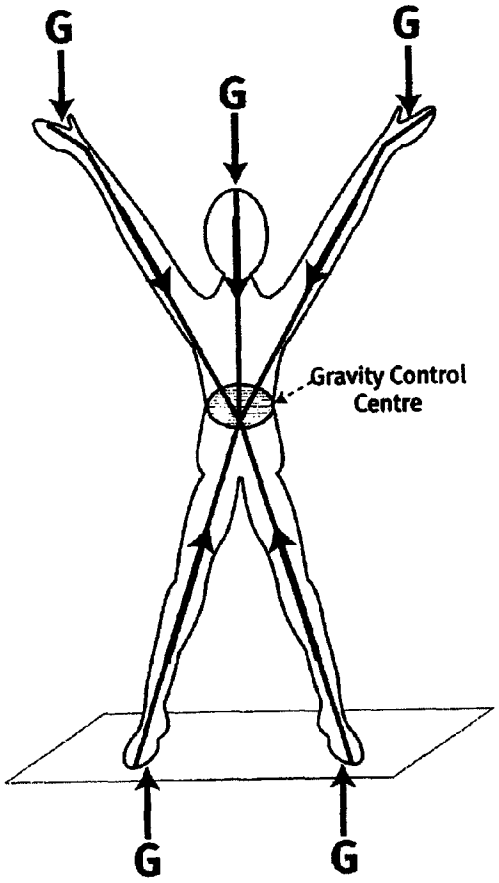
FIGS. 1A and 1B depict how the antigravity muscles of a human being counteract the effects of gravity on the limbs and torso of that being.
Figure 1B:
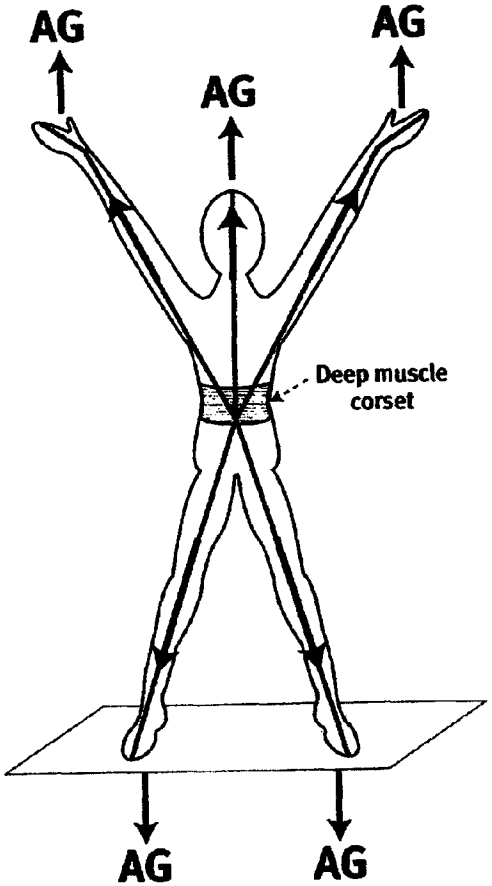
Figure 2:
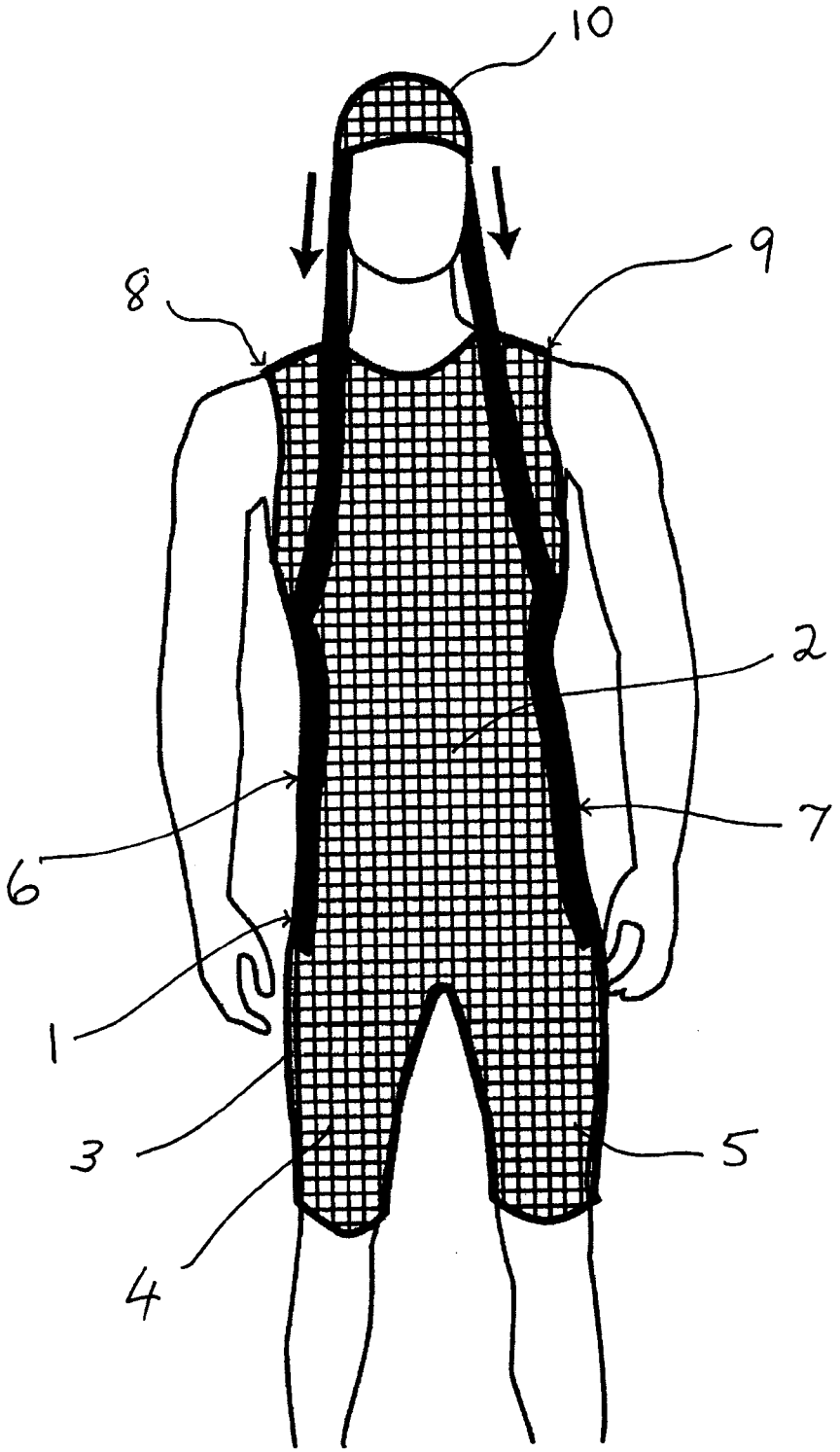
FIG. 2 is a front view of a person wearing a garment comprising an antigravity muscle exerciser according to the invention.

A garment as defined above comprising an exerciser for providing axial compression of the spine is illustrated in FIG. 2. In that figure, garment 1 is shown comprising a sleeveless upper body portion 2 and lower portion 3 with legs 4 and 5 which extend to just above the knees of a wearer. Upper body portion 2 has first portions of flexible material 6 and 7 which extend along a respective side of the wearer to bifurcate around the arm holes 8 and 9 to rejoin above the shoulders. The portions then extend to a second portion of flexible material 10 that fits on the head of a wearer.

Garment 1 is fabricated from any suitable stretch fabric so that the garment is close-fitting but nevertheless allows free movement. A suitable fabric is that known as spandex.

Figure 3:
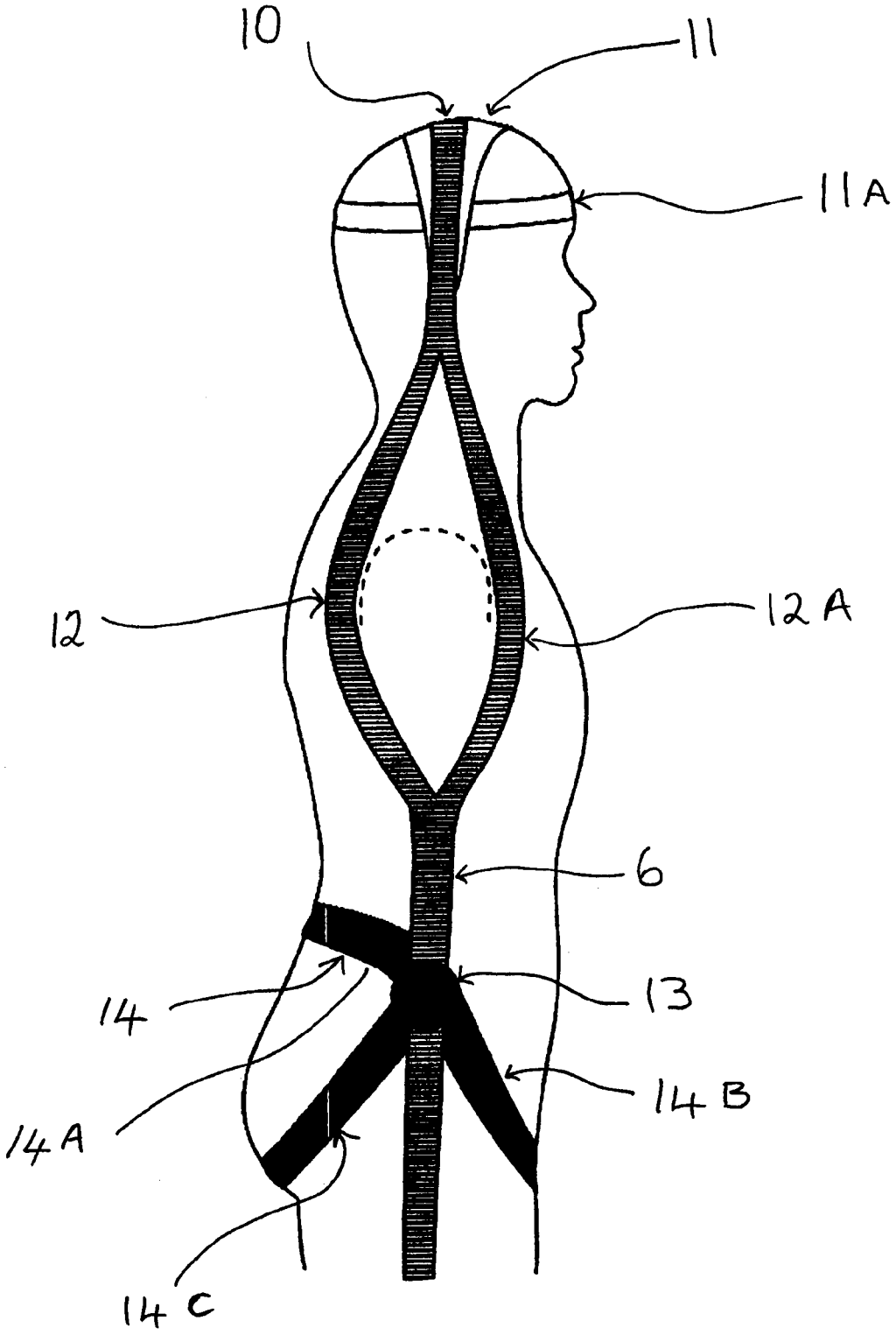
FIG. 3 is a side view of the person and garment depicted in FIG. 2 to show components of the garment in greater detail.

The bifurcation of portion 6 can be seen in the side view of FIG. 3 as items 12 and 12*a*. It can also be appreciated from FIG. 3 that portion 6 extends from the pelvis at a lateral anchor point 13. It can be further appreciated from this figure that portion 10 that fits on the head of a wearer has broadened portion 11 that lies in the coronal plane and can be supported in the correct coronal alignment by a headband 11*a*. That portion can alternatively be in the form of a cap or bifurcated straps. Portion 10 can also be incorporated into a hood that forms part of the garment per se.

Lower body portion 3 of garment 1 is shown with knee-length legs. However, the lower body portion can be without legs and hence in essence comprise a pair of briefs.

Regardless of the form of the lower body portion, portion 6 can be attached to the pelvis at lateral point 13 which forms a part of a continuous pelvic band of flexible material 14 extending from the low back region 14*a* and encircling the upper part of the legs (see items 14*b* and 14*c*). Alternatively, the portion can comprise fabric which adequately anchors bands 6 and 7 (see FIG. 2) to the pelvis when the user is exercising.

As indicated above in the definition of the subject embodiment in FIG. 2, upper body portion 2 and lower body portion 3 can be joined in a single unitary garment. When worn as separate portions, means can be provided for reversibly connecting the two portions to each other, typically at the waist. A suitable connecting means comprises hook and loop fasteners.

In forms of the garment where upper body portion 2 and lower body portion 3 are separate articles, the portions of flexible material 6 and 7 can have adaptations at free ends for attaching the ends to the lower body portion garment. These adaptations can be any suitable fixing means including hook and loop fasteners, and buckles.

The portions of flexible material 6 and 7 of upper body portion 2 of garment 1 in the region of the torso can comprise two-way stretch fabric. The two-way stretch fabric is advantageously incorporated into the fabric of the garment.

Providing Axial Compression of the Spine and the Limbs

Figure 4A:
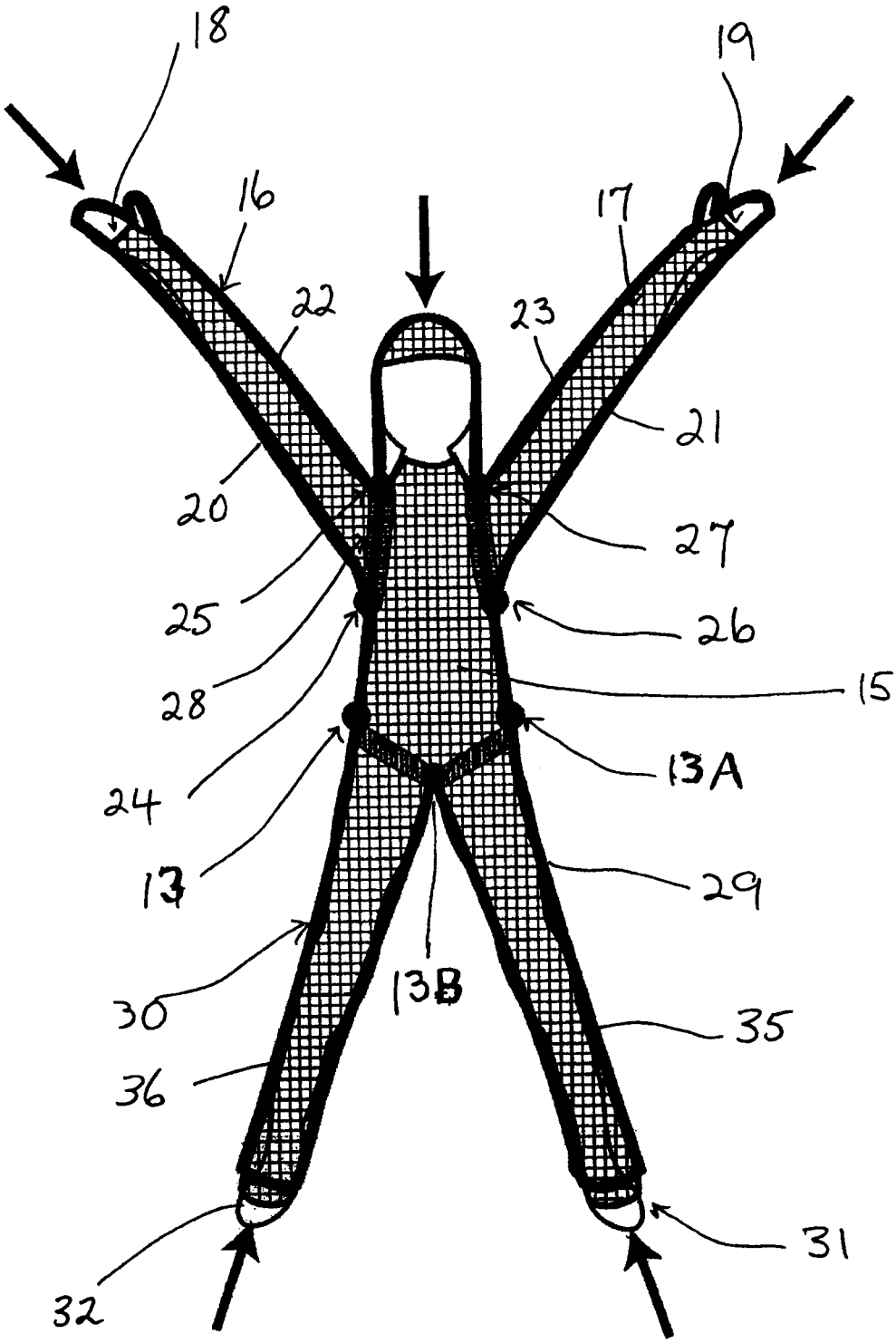
FIGS. 4A and 4B are front and back views, respectively, of an exerciser article which includes components for exercising the antigravity muscles of the upper and lower limbs as well as the spine.
Figure 4B:
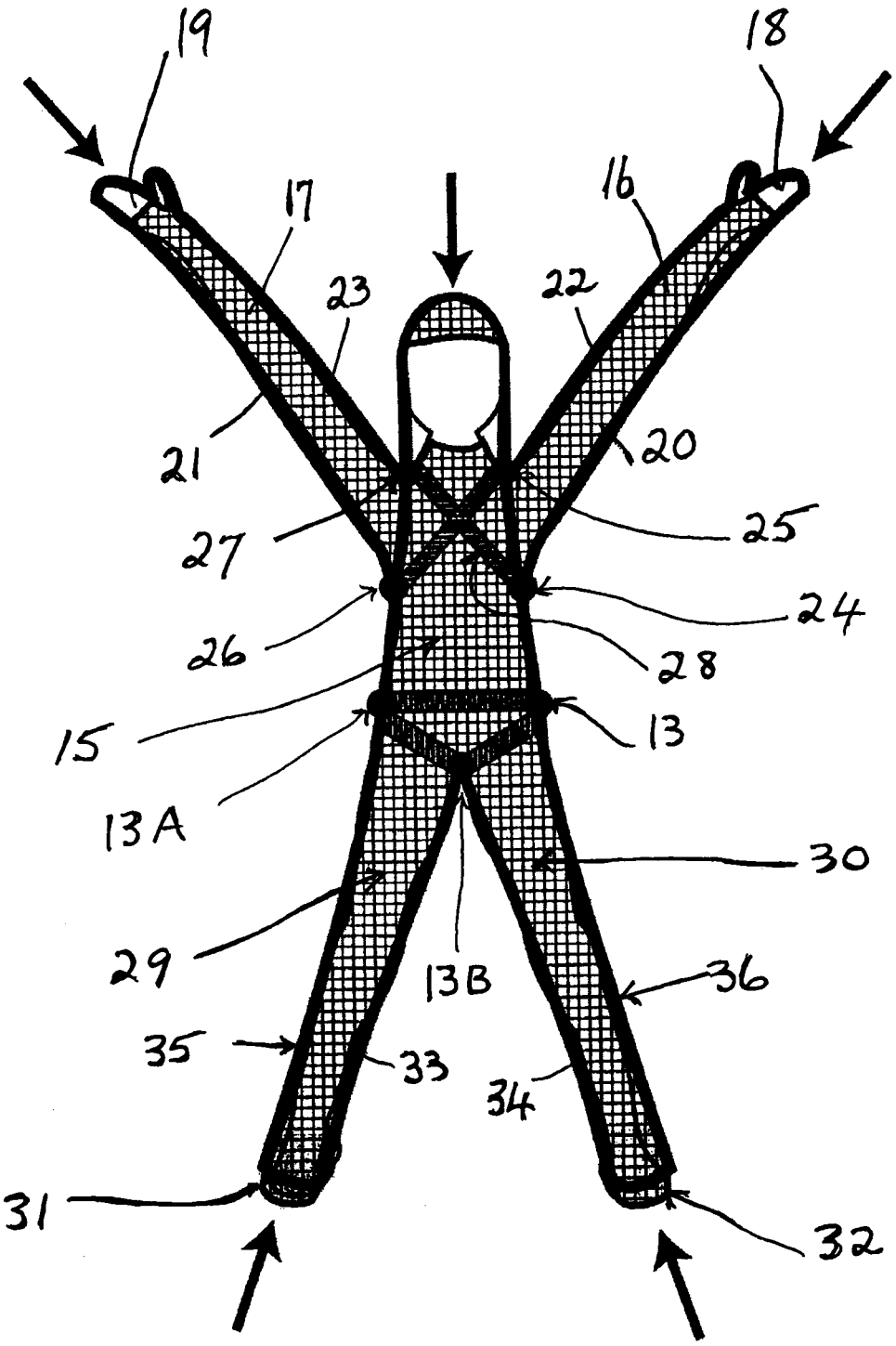

Another form of exercise garment is illustrated in FIGS. 4A and 4B. This garment 15 is in essence a suit in that it comprises fabric which extends to the heels of the feet and heels of the hands of a wearer as generally indicated by the hatching in these figures. Suit 15 includes bands of flexible material 16 and 17 with two-way stretch which include an adaptation for receiving the heel of each hand 18 and 19 of the wearer. Bands 16 and 17 extend along the medial, 20 and 21, and lateral, 22 and 23, sides of a respective upper limb and around a heel of a respective hand 18 or 19. Bands 16 and 17 are preferably attached at anchor points 24 and 25, and 26 and 27, respectively, to a continuous band of flexible material 28. It can be appreciated from the two figures that band 28 crosses the upper back region of the wearer and encircles the upper part of each arm.

Bands 16 and 17 have a length and elasticity which allow movement of the upper limbs to create axial compression between the shoulder and heels of the hands. The bands can be either attached to the fabric comprising the sleeves, or incorporated into that fabric.

FIGS. 4A and 4B additionally illustrates that suit 15 can also include bands of flexible material 29 and 30 with two-way stretch which include an adaptation for receiving the heel of each foot 31 and 32 of the wearer. Bands 29 and 30 extend along the medial, 33 and 34, and lateral, 35 and 36, sides of a respective lower limb and around a heel of a respective foot 31 or 32. Bands 29 and 30 are preferably attached at anchor points 13, 13*a* and 13*b* to a continuous band of flexible material 14 (see FIG. 3).

Bands 29 and 30 have a length and elasticity which allow movement of the lower limbs to create axial compression between the pelvis and heels of the feet. The bands can be either attached to the fabric comprising the legs of the suit, or incorporated into that fabric.

With further reference to the second embodiment method, in instances where the garment is a suit that includes sleeves and/or legs, the method can further include extending and relaxing the upper limbs and/or lower limbs to increase the level of antigravity exercise.

In instances where the garment does no include sleeves and/or legs, the garment can include adaptations at the shoulder or pelvic anchor points for attaching additional exercise articles. Such articles include elastic bands or springs for increasing axial longitudinal compression to the upper and/or lower limbs.

Figure 5:
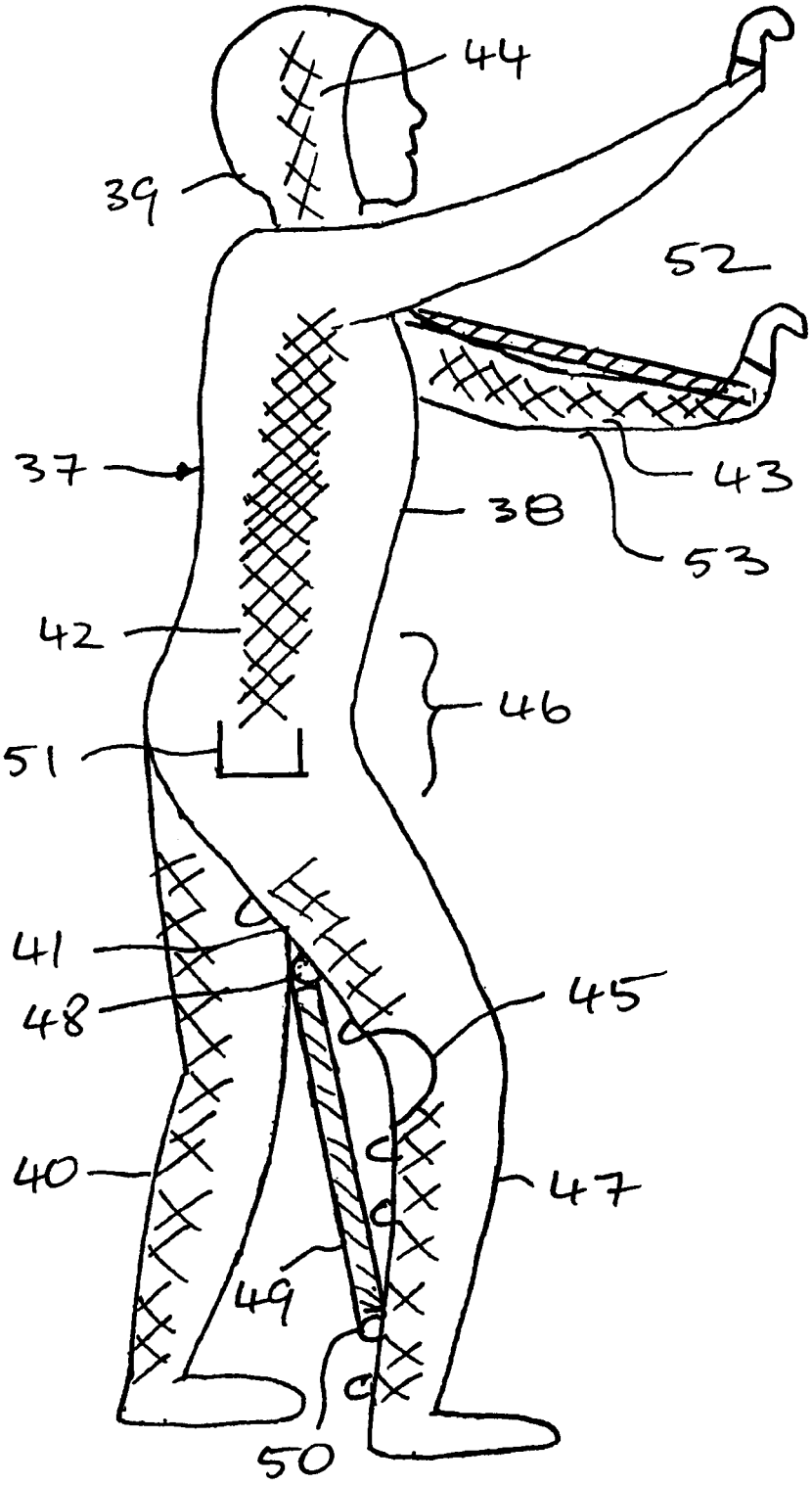
FIG. 5 is a side view of a person wearing an exercise suit according to the invention in which additional features of the suit are depicted.

In FIG. 5 there is shown an exercise suit according to the invention. Suit 37 comprises tight-fitting fabric that extends from the feet of user 38 through the torso to at least the palms of the hands (in the form of a partial glove) and includes a hood 39. Bands of material of the desired elasticity are incorporated into the suit as generally indicated by cross-hatching. The areas where these bands are included comprise at least along the backs of the legs 40 and 41, each side of the torso (item 42 of the side visible in the drawing), along the front of the sleeves (item 43 of one of the sleeves visible in the drawing), and at least on the side of the hood (item 44). However, gussets can be provided in the areas of the suit behind a knee and in the crook of the arm to not limit the flexing of a limb in these areas. A gusset is generally indicated as item 45.

The material of the suit around the feet and hands can be inextensible to afford anchoring of applied force at these points. An inextensible band or bands of fabric can also be included in the pelvic girdle region 46.

Resistance to extension of a limb or the torso can be increased in suit 37 by fitting additional elastic members. This will be illustrated by reference to a portion of suit 37 that covers lower limb 47. A plurality of loops or other attachment means are provided along the back of the leg of the suit. One of these loops is item 48. An elastic member 49 which will afford the desired increase in resistance is fitted between loop 48 and a second loop 50.

The compressive force between the head and the pelvic region can be varied by including an adjustment means on each side of the suit. A suitable adjustment means is in the form of a flap which is item 51 on the side of the suit visible in the drawing. The free end of the flap can be attached to the fabric of the suit per se using an attachment means such as hook and loop material. By varying the point of attachment, the tension applied by the elastic bands can be varied.

Adjustment means like that described in the previous paragraph can be similarly provided for the sleeves and legs of the suit.

Resistance to extension of the upper limbs, like resistance to extension of the lower limbs, can be affected by attaching at least one elastic member, item 52 in FIG. 5, to the fabric comprising sleeve 53.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term 'comprise' and variants of the term such as 'comprises' or 'comprising' are used herein to denote the inclusion of a stated integer or stated integers but not to exclude any other integer or any other integers, unless in the context or usage an exclusive interpretation of the term is required.

Any reference to publications cited in this specification is not an admission that the disclosures constitute common general knowledge in Australia.

The invention claimed is:

1. An antigravity muscle exerciser comprising a garment fabricated from material which when worn by a user is close-fitting and covers at least the torso of said user, wherein the garment comprises separate top and bottom portions or is a one-piece article, and wherein the garment has incorporated therein:

first portions of flexible material on each side of the torso which extend from the pelvis to beyond a respective shoulder where the portions are contiguous with a second portion of flexible material which extends across the top of the head of the user in a coronal plane, wherein said first portions of flexible material in combination with the second portion of flexible material have a length and elasticity which creates axial compression between the top of the head and the pelvis, and wherein the portions of flexible material are bifurcated around each armhole of the garment.

2. The antigravity muscle exerciser garment of claim 1, wherein only parts of the first and/or second portions of flexible material are elastic.

3. The antigravity muscle exerciser garment of claim 1, wherein the first and second portions of flexible material are combined and only part of the combination is elastic.

4. The antigravity muscle exerciser garment of claim 1, wherein the portions of flexible material that extend from the pelvis are anchored in the pelvic area by loops which are worn around the legs of a user in the region of the upper thigh.

5. The antigravity muscle exerciser garment of claim 1, wherein:

the portions of flexible material that extend from the pelvis are anchored in the pelvic area by loops which are worn around the legs of a user in the region of the upper thigh; and the looped members are contiguous with the portions of material.

6. The antigravity muscle exerciser garment of claim 5, wherein the looped members are present in combination with a further member that extends across the back of a wearer in the lower lumbar region.

7. The antigravity muscle exerciser garment of claim 1, wherein the portion of flexible material at the crown of the head comprises branched portions.

8. The antigravity muscle exerciser garment of claim 1, wherein the second portion of flexible material is incorporated into a hood that is a part of the garment.

9. The antigravity muscle exerciser garment of claim 1, wherein the portions of flexible material in the region of the torso are contained within a sleeve attached to the fabric of the garment.

10. The antigravity muscle exerciser garment of claim 1, wherein the portions of flexible material comprise two-way stretch fabric incorporated into the fabric of the garment.

11. A method of exercising deep posture and antigravity muscles of a user wearing the garment of claim 1, the method comprising the steps of:

(a) extending the crown of the head away from the pelvis, wherein said extending is to increase axial compression;

(b) relaxing the torso to allow the elastic bands to retract, wherein said relaxing is to decrease axial compression;

(c) repeating steps (a) and (b) as required until said deep posture and antigravity muscles are sufficiently exercised; and (d) optionally removing the band of flexible material across the crown of the head and continuing the repetition of steps (a) and (b).

* * * * *